US009579560B2

(12) United States Patent
Renner et al.

(10) Patent No.: US 9,579,560 B2
(45) Date of Patent: Feb. 28, 2017

(54) INTERACTIVE CUSTOMIZABLE AUDIO-VISUAL TOY

(71) Applicants: Karen D. Renner, Columbia, MO (US); Kristin R. Branscom, Columbia, MO (US); Jodi L. Houin, Columbia, MO (US)

(72) Inventors: Karen D. Renner, Columbia, MO (US); Kristin R. Branscom, Columbia, MO (US); Jodi L. Houin, Columbia, MO (US)

( * ) Notice: Subject to any disclaimer, the term of this patent is extended or adjusted under 35 U.S.C. 154(b) by 0 days.

(21) Appl. No.: 15/098,690

(22) Filed: Apr. 14, 2016

(65) Prior Publication Data

US 2016/0303471 A1 Oct. 20, 2016

Related U.S. Application Data

(60) Provisional application No. 62/148,437, filed on Apr. 16, 2015.

(51) Int. Cl.
*A63F 9/08* (2006.01)
*A63F 9/06* (2006.01)

(52) U.S. Cl.
CPC ..... *A63F 9/0612* (2013.01); *A63F 9/0666* (2013.01)

(58) Field of Classification Search
CPC .... A63F 9/0612; A63F 9/0666; A63F 9/0602; A63F 2009/0668; A63F 9/0073; A63F 3/00574; A63F 3/0695; A63F 2003/0047
See application file for complete search history.

(56) References Cited

U.S. PATENT DOCUMENTS 741,903 A * 10/1903 Gates ..... A63F 9/06 273/153 R
3,510,964 A * 5/1970 Dahners ..... G09B 19/0023 273/160
3,748,748 A 7/1973 Bevan et al.
4,286,952 A * 9/1981 Roche ..... G09B 1/10 273/156
4,487,585 A * 12/1984 Goldwasser ..... A63F 9/10 273/156
4,952,153 A 8/1990 McAllister
5,087,043 A * 2/1992 Billings ..... A63F 9/10 273/157 R
5,120,226 A * 6/1992 Tsai ..... A63F 3/0415 434/195
5,190,287 A * 3/1993 Ishiyama ..... A63F 9/0666 273/156

(Continued)

*Primary Examiner* — Steven Wong
(74) *Attorney, Agent, or Firm* — Armstrong Teasdale LLP

(57) ABSTRACT

A user-customizable audio-visual puzzle includes a platform having a base layer, a middle layer, and a top layer coupled together. The middle layer includes a first cavity therein. The top layer includes at least one cutout therethrough. The puzzle further includes at least one puzzle piece having a peripheral configuration shaped to correspond to the at least one cutout in the top layer. A drawer is configured to be removably positionable within the first cavity of the middle layer. The drawer includes at least one second cavity configured to be positioned generally beneath the at least one cutout when the drawer is positioned within the first cavity. The puzzle also includes a recording system configured to record a message associated with the at least one cutout.

20 Claims, 5 Drawing Sheets

(56) References Cited

U.S. PATENT DOCUMENTS

| | | | | |
|---|---|---|---|---|
| 5,433,610 | A | 7/1995 | Godfrey et al. | |
| 5,752,701 | A * | 5/1998 | Kao | A63F 3/00574 273/153 R |
| 5,823,532 | A | 10/1998 | Goldwasser et al. | |
| 6,868,630 | B2 | 3/2005 | Kim | |
| 6,979,245 | B1 | 12/2005 | Goodwin | |
| 7,234,941 | B2 | 6/2007 | Shuler et al. | |
| 7,427,066 | B1 | 9/2008 | Goodwin | |
| 7,510,187 | B2 | 3/2009 | Haag | |
| 7,585,216 | B2 | 9/2009 | Foster | |
| 8,191,895 | B2 | 6/2012 | Gearty | |
| 8,413,988 | B2 | 4/2013 | Gearty | |
| 9,311,822 | B2 * | 4/2016 | Lam | G09B 1/06 |
| 2007/0085269 | A1 * | 4/2007 | Martin, Jr. | A63F 9/10 273/157 R |
| 2007/0278740 | A1 * | 12/2007 | Mao | A63F 9/10 273/157 R |
| 2010/0032898 | A1 | 2/2010 | Gearty | |
| 2011/0031689 | A1 | 2/2011 | Binder | |
| 2011/0227284 | A1 | 9/2011 | Gearty | |
| 2013/0079080 | A1 | 3/2013 | Binder | |
| 2016/0303471 | A1 * | 10/2016 | Renner | A63F 9/0666 |

* cited by examiner

INTERACTIVE CUSTOMIZABLE AUDIO-VISUAL TOY

CROSS REFERENCE TO RELATED APPLICATIONS

This application claims the benefit of U.S. Provisional Patent Application No. 62/148,437 filed Apr. 16, 2015, which is hereby incorporated by reference in its entirety.

FIELD

The field of the disclosure relates generally to audio-visual toys. More particularly, this disclosure relates to an interactive user-customizable audio-visual puzzle toy that may be customized by a user to integrate images and audio recordings selected by the user.

BACKGROUND

In some known audio-visual puzzles, a user is provided with a puzzle piece that is shaped like an animal or another common object, such as a car or an airplane. When the user removes the puzzle piece from the puzzle frame, the puzzle emits a sound that is commonly associated with the particular object shown on the puzzle piece. Is this manner, the user's recognition of the object and association of the sound with that object is reinforced. At least some known puzzles, however, provide only a few different shapes and sounds, and thereby provide little opportunity for expanding the user's recognition and association skills.

Accordingly, a need exists for a user-customizable audio-visual puzzle that enables the user to change the visual representations of the puzzle and the sounds associated with such visual representations.

BRIEF DESCRIPTION

In one aspect, a user-customizable audio-visual puzzle is provided. The puzzle includes a platform having a base layer, a middle layer coupled to the base layer, the middle layer defining a first cavity therein, and a top layer coupled to the middle layer, the top layer including at least one cutout. The puzzle also includes at least one puzzle piece having a peripheral configuration shaped to correspond to the at least one cutout. Further, the puzzle includes a drawer configured to be removably positionable within the first cavity. The drawer includes at least one second cavity configured to be positioned generally beneath the at least one cutout when the drawer is positioned within the first cavity. In addition, the puzzle includes a recording system configured to record a message associated with the at least one cutout.

In another aspect, a user-customizable audio-visual puzzle is provided. The puzzle includes a platform having a first layer including a cutout and a lip that extends inwardly from a periphery of the cutout. The lip includes a magnetic material. The platform also includes a second layer coupled to the first layer. The second layer defines a first cavity therein. The puzzle includes a puzzle piece having a magnetic material and a peripheral configuration shaped to correspond to the cutout. The puzzle piece is configured to be removably coupled to the first layer by a magnetic attraction force between the lip of the first layer and the at least one puzzle piece. The puzzle also includes a drawer configured to be removably positionable within the first cavity. In addition, the puzzle includes a recording system configured to record a message associated with the cutout. The recording system includes a microphone for receiving a sound signal corresponding to the message, a speaker for playing the message, and a switch positioned within the cutout. Activation of the switch causes the recording system to play the message from the speaker.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DETAILED DESCRIPTION

The systems described herein can include or represent hardware and associated instructions (e.g., software stored on a tangible and non-transitory computer readable storage medium, such as a computer hard drive, ROM, RAM, or the like) that perform the operations described herein. The hardware may include electronic circuits that include and/or are connected to one or more logic-based devices, such as microprocessors, processors, or the like. These devices may be off-the-shelf devices that perform the operations described herein from the instructions described above. Additionally or alternatively, one or more of these devices may be hard-wired with logic circuits to perform these operations.

Figure 1:
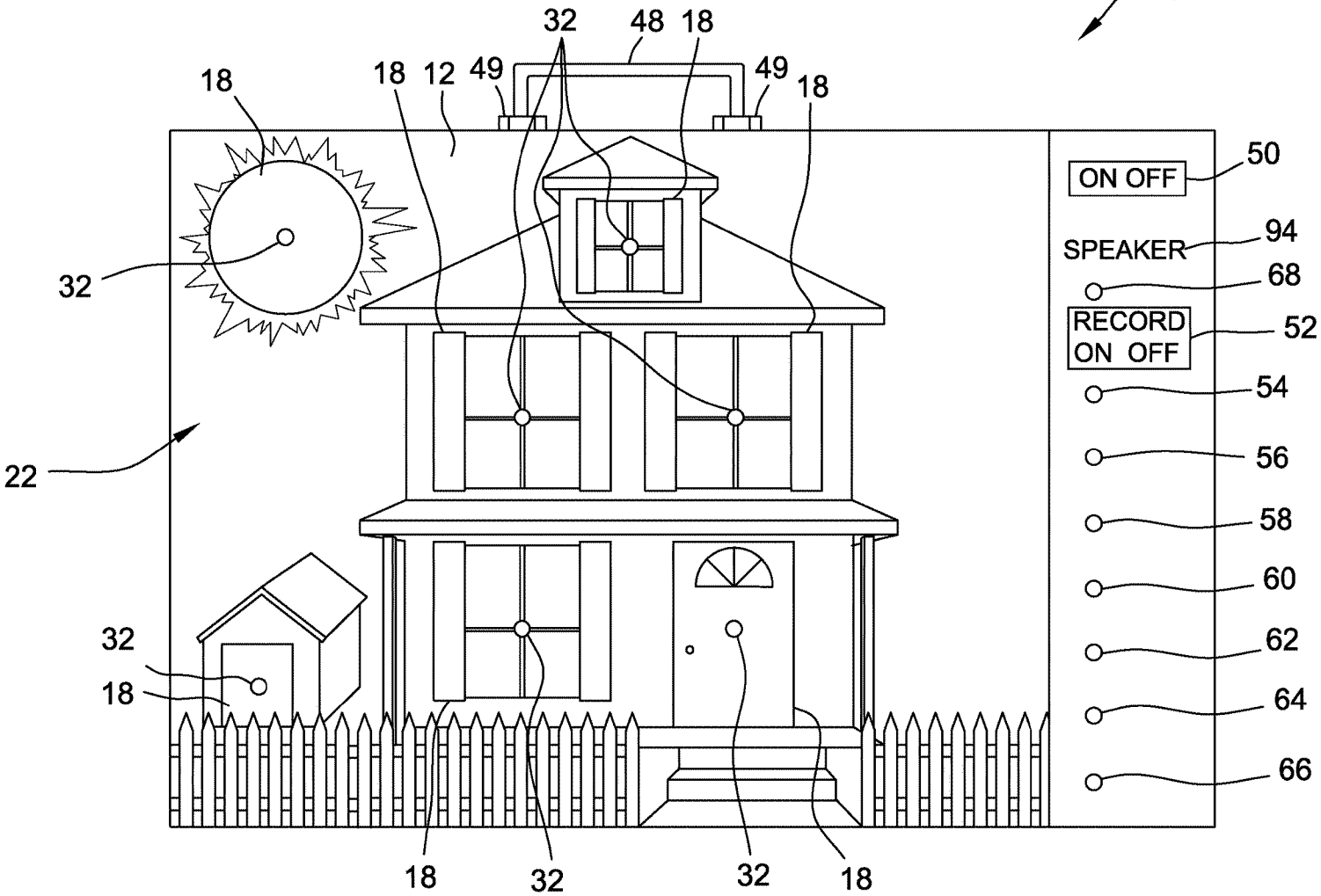
FIG. 1 is a top view of one embodiment of a user-customizable audio-visual puzzle.
Figure 2:
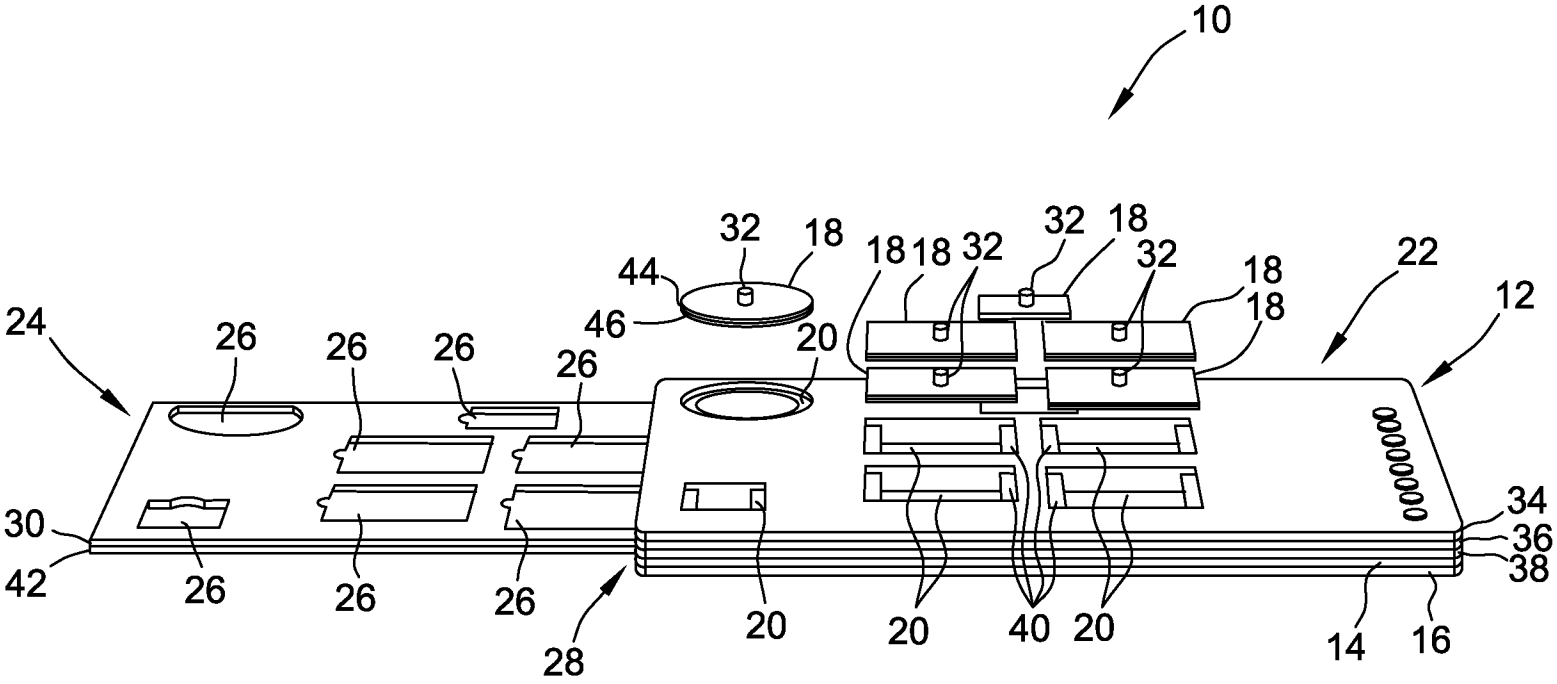
FIG. 2 is a perspective view of the user-customizable audio-visual puzzle shown in FIG. 1.

Referring to FIGS. 1 and 2, a user-customizable audio-visual puzzle 10 comprises platform having a top layer 12, a middle layer 14 disposed generally beneath the top layer 12, and a base layer 16 disposed generally beneath the middle layer 14. The top layer 12 comprises a plurality of cutouts 20. The puzzle 10 also includes a plurality of removable puzzle pieces 18. Each puzzle piece 18 has a peripheral configuration shaped to correspond to a respective one of the plurality of cutouts 20. The peripheral configuration of each of the puzzle pieces 18, and its corresponding cutout 20, can vary in size and shape from, or can be the same as, others of puzzle pieces 18 and their associated cutouts 20. In addition, in the example embodiment, a knob 32 is coupled to each puzzle piece 18 to facilitate removal of the puzzle piece 18 from its corresponding cutout 20. In one suitable embodiment, the puzzle 10 includes a handle 48 pivotably coupled to an edge of the platform of the puzzle 10. The handle 48 can be coupled to the platform of the puzzle 10 via hinges 49 to enable the puzzle 10 to be oriented in a generally vertical orientation when carried by the handle 48.

In the example embodiment, the top layer 12 and the puzzle pieces 18 each include portions of a background image 22. The portions of the background image 22 placed on the puzzle pieces 18 may be configured to assist a user in correct placement of the puzzle pieces 18 into the associated cutouts 20. For example, in the example embodiment, a portion of the background image 22 shows a house. The puzzle pieces 18 associated with the cutouts 20 of the house portion of the background image 22 include window and door portions of the background image 22. Thus, the user may be assisted in placement of the puzzle pieces 18 into the correct cutouts 20 by his or her recognition and association of windows and doors with a house. In alternative embodiments, the background image 22 can be omitted.

Figure 3:
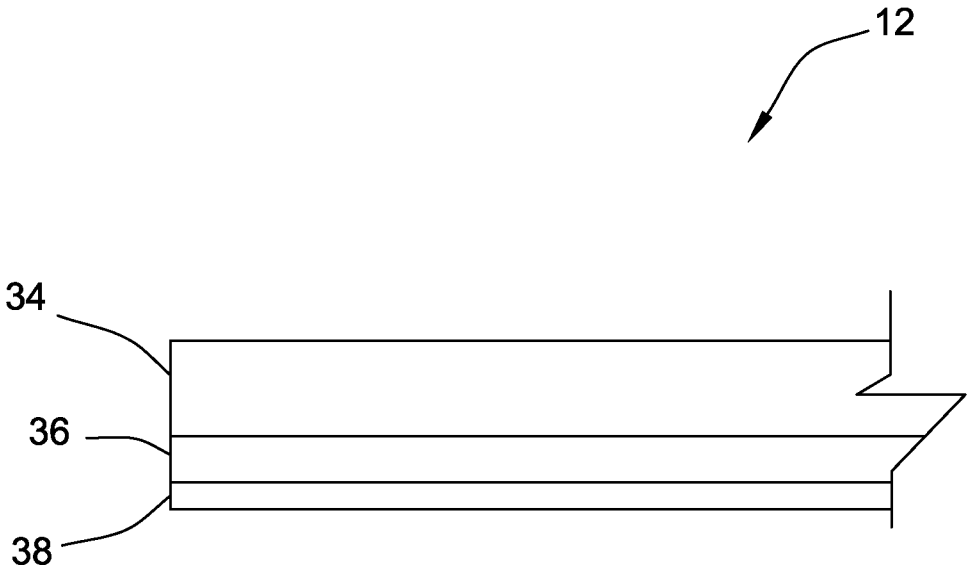
FIG. 3 is a schematic diagram of an example top layer of the user-customizable audio-visual puzzle shown in FIGS. 1 and 2.

FIG. 3 is a schematic diagram of the top layer 12 of the puzzle 10. The top layer 12 can be formed from a multi-ply construction including a top ply 34, a center ply 36 coupled to the top ply 34, and a bottom ply 38 coupled to the center ply 36. The top ply 34, center ply 36, and bottom ply 38 may be coupled together to form top layer 12 in any suitable fashion, such as by a suitable adhesive or mechanical fasteners.

The top ply 34 may be fabricated from plywood. Alternatively, the top ply 34 may be fabricated from any material that enables the puzzle 10 to function as described herein, for example, without limitation, wood, plastic, masonite board, etc. The center ply 36 may be fabricated from a magnetic sheet material, for example. The bottom ply 38 may be fabricated from a transparent material, for example, without limitation, an acetate film. The top layer 12 is configured such that the cutouts 20 extend through the top ply 34 and the center ply 36, but not through the bottom ply 38. Thus, the transparent bottom ply 38 is configured to facilitate viewing of pictures positioned beneath top layer 12, as will be described in more detail below, while protecting the pictures from damage. In alternative embodiments, cutouts 20 extend completely through top layer 12.

Returning to FIG. 2, in the example embodiment, the center ply 36 includes a plurality of extended lips 40 that extend inwardly from the periphery of the cutouts 20. The plurality of lips 40 is configured to support the puzzle pieces 18 within the cutouts 20. The lips 40 facilitate contact between magnetic center ply 36 and puzzle pieces 18, and also facilitate avoiding contact between the puzzle pieces 18 and transparent bottom ply 38. In alternative embodiment, the center ply 36 does not include the plurality of extended lips 40.

In the example embodiment, the middle layer 14 is fabricated from plywood. Alternatively, the middle layer 14 may be fabricated from any material that enables the puzzle 10 to function as described herein, for example, without limitation, wood, plastic, masonite board, etc. A first cavity 28 is defined in the middle layer 14, and the puzzle 10 includes a drawer 24 configured to be removably positioned at least partially within the first cavity 28. More specifically, the first cavity 28 is shaped to accommodate the peripheral configuration of the drawer 24, and is sized at least slightly larger than the drawer 24, to enable at least a portion of the drawer 24 to be positioned in the first cavity 28. In the example embodiment, the drawer 24 has a rectangular-shaped peripheral configuration, and is configured to enable a user to selectively slide drawer 24 into and out of the first cavity 28. In alternative embodiments, the peripheral configuration of the drawer 24 may be any shape that enables drawer 24 to function as described herein.

In the example embodiment, the drawer 24 includes a plurality of second cavities 26. Second cavities 26 are configured such that, when drawer 24 is positioned at least partially within first cavity 28, each second cavity 26 is positioned generally beneath a corresponding one of the cutouts 20 formed in the top layer 12. Each second cavity 26 is configured to hold a picture (not shown) selected by the user for use with the puzzle 10. In the example embodiment, the drawer 24 is formed from a top ply 30 coupled to a bottom ply 42. Each second cavity 26 is defined in the top ply 30, and the bottom ply 42 is a generally continuous sheet configured to support the pictures (not shown) in the plurality of second cavities 26. For example, the top ply 30 and the bottom ply 42 may be fabricated from plywood. Alternatively, the top ply 30 and the bottom ply 42 may be fabricated from any material that enables the drawer 24 to function as described herein, for example, without limitation, wood, plastic, masonite board, etc. The top ply 30 and the bottom ply 42 may be coupled together in any suitable fashion, such as by suitable adhesive or mechanical fasteners.

In an alternative embodiment, the drawer 24 includes one large picture cavity 26 configured to extend beneath each of the cutouts 20. In such an embodiment, a single sheet may be placed into the cavity 26. For example, the single sheet may include a plurality of different scenes, each scene being positioned below a cutout 20 in the top layer 12 of the puzzle 10.

The base layer 16 of the puzzle 10 is a generally continuous layer configured to support the top layer 12 and the middle layer 14. In the exemplary embodiment, the base layer is fabricated from plywood. Alternatively, the base layer 16 may be fabricated from any material that enables the puzzle 10 to function as described herein, for example, without limitation, wood, plastic, masonite board, etc. In an alternative embodiment, the base layer 16 may include a magnetic ply (not shown) coupled to a bottom surface of the base layer 16 to facilitate positioning the puzzle 10 on a magnetic surface. In the example embodiment, the top layer 12, the middle layer 14, and the base layer 16 are coupled together using a suitable adhesive. Alternatively, the layers 12, 14, and 16 may be coupled together using mechanical fasteners, such as, without limitation, screws, rivets, etc.

In the example embodiment, the puzzle pieces 18 are a multi-ply construction including a top layer 44 fabricated from plywood and a bottom layer 46 fabricated from a magnetic sheet material. Alternatively, the top layer 44 may be fabricated from any material that enables the puzzle pieces 18 to function as described herein, for example, without limitation, wood, plastic, masonite board, etc. The top layer 44 and the bottom layer 46 are coupled together using a suitable adhesive. Alternatively, the top layer 44 and the bottom layer 46 may be coupled together using mechanical fasteners.

In operation, the user can use the puzzle pieces 18 as templates to cut pictures to be placed into the plurality of second cavities 26 defined in the drawer 24. The drawer 24 is positioned at least partially within the first cavity 28, thereby positioning each second cavity 26 under a respective cutout 20 such that, when a puzzle piece 18 is not present in the cutout 20, the picture in the corresponding second cavity 26 may be viewed by the user. The transparent bottom ply 38 of the top layer 12 enables the user to see the pictures through the cutouts 20, while simultaneously protecting the pictures from, for example, touching, liquid spills, etc. The user places each puzzle piece 18 into its corresponding cutout 20, thereby covering the picture below. The magnetic bottom layer 46 of each puzzle piece 18 overlies the corresponding lip 40 of the magnetic center ply 36 of the top layer 12 such that each puzzle piece 18 is removably coupled to the top layer 12 via a magnetic attraction force. For example, the lip 40 may hold the puzzle piece 18 in place in the corresponding cutout 20 when the puzzle 10 is moved to a vertical or upside-down position.

Figure 4:
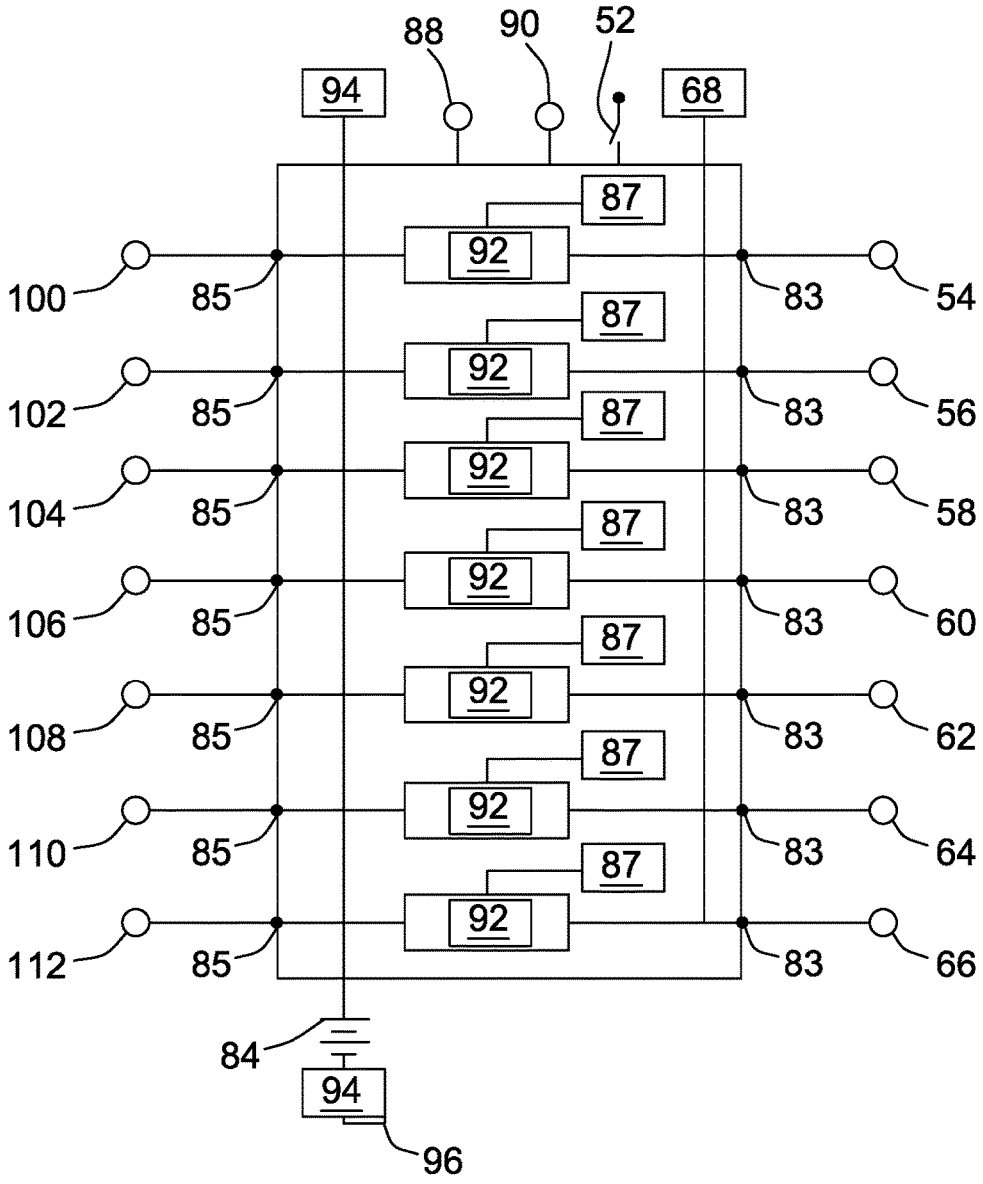
FIG. 4 is a simplified block diagram of an example electronic recording circuit for use with the puzzle shown in FIGS. 1 and 2.

FIG. 4 shows a simplified block diagram of a recording system 80 that is operatively coupled to the puzzle 10. In the example embodiment, the recording system 80 comprises a power switch 50, a microphone 68, a microprocessor 82, a battery 84, a battery charger 86, a power LED 88, a status LED 90, a plurality of audio recording/playback circuits 92, and a speaker 94. The microprocessor 82 includes a plurality of record inputs 83, each configured to enable microprocessor 82 to selectively receive and store one of a plurality of discrete audio messages 87, and a plurality of playback inputs 85 each configured to enable the microprocessor 82 to selectively play back one of the plurality of discrete audio messages 87. More specifically, each recording/playback circuit 92 is operatively coupled to one of the record inputs 83 and one of the playback inputs 85 to enable selective recording and playback of the corresponding message 87.

In the example embodiment shown in FIG. 4, the plurality of audio recording/playback circuits 92 is incorporated into the microprocessor 82 in a single multiple-message record/playback device, such as an ISD 1900 ChipCorder® Series chip manufactured by Nuvoton. In alternative embodiments, the microprocessor 82 and the plurality of audio recording/playback circuits 92 are formed from any suitable combination of microprocessors, sound chips, and/or associated electronic circuitry that enables recording system 80 to function as described herein. In the example embodiment, the microprocessor 82 includes seven record inputs 83 and seven playback inputs 85 to enable it to play back seven separate messages 87. Alternatively, the microprocessor 82 and the recording system 80 may include more than or fewer than seven record inputs 83, playback inputs 85, messages 87, and audio recording/playback circuits 92, respectively. In the example embodiment, record inputs 83 and playback inputs 85 are the same input on the microprocessor 82. Alternatively, record inputs 83 and playback inputs 85 may be separate inputs on the microprocessor 82.

With reference to FIGS. 1-4, each of the audio recording/playback circuits 92 is operatively coupled to a corresponding one of a plurality of record buttons 54, 56, 58, 60, 62, 64, and 66 via a corresponding one of the plurality of record inputs 83 of microprocessor 82. More specifically, activation of one of the plurality of record buttons 54, 56, 58, 60, 62, 64, and 66 enables microprocessor 82 to receive a sound signal from microphone 68 and store the sound signal as a corresponding message 87. Moreover, each one of the plurality of record buttons 54, 56, 58, 60, 62, 64, and 66 is associated with a respective cutout 20 and its corresponding puzzle piece 18, thereby enabling the user to associate the message 87 with a particular cutout 20 and puzzle piece 18 combination. To assist a user in matching each record button 54, 56, 58, 60, 62, 64, and 66 to its associated cutout 20 and puzzle piece 18 combination, each of the record buttons may be, for example, color coded to match a color of the knob 32 coupled to the associated puzzle piece 18.

In the example embodiment, recording system 80 also includes a global record switch 52. Global record switch 52 is operatively coupled to microprocessor 82 and is operable to selectively prevent recording by recording system 80. For example, microprocessor 82 is configured such that all audio recording/playback circuits 92 are disabled when global record switch 52 is not activated. Thus, global record switch 52 is configured to prevent recording of new messages 87 by recording system 80 when any one of the record buttons 54, 56, 58, 60, 62, 64, and 66 is inadvertently activated.

In addition, each of the audio recording/playback circuits 92 is operatively coupled to a corresponding one of a plurality of switches 100, 102, 104, 106, 108, 110, and 112 via a corresponding one of the plurality of playback inputs 85 of microprocessor 82. In the exemplary embodiment, the switches 100, 102, 104, 106, 108, 110, and 112 are photocells. Alternatively, the switches may be any type of switch that enables the recording system 80 to function as described herein, for example, mechanical switches. Specifically, activation of one of the plurality of switches 100, 102, 104, 106, 108, 110, and 112 causes microprocessor 82 to play the corresponding message 87 as a sound signal from speaker 94. In addition, each of the corresponding switches 100, 102, 104, 106, 108, 110, and 112 is positioned within the associated cutout 20 such that ambient light sufficient to trigger the photocell can reach the photocell only when a puzzle piece 18 is not positioned within the cutout 20.

Figure 5:
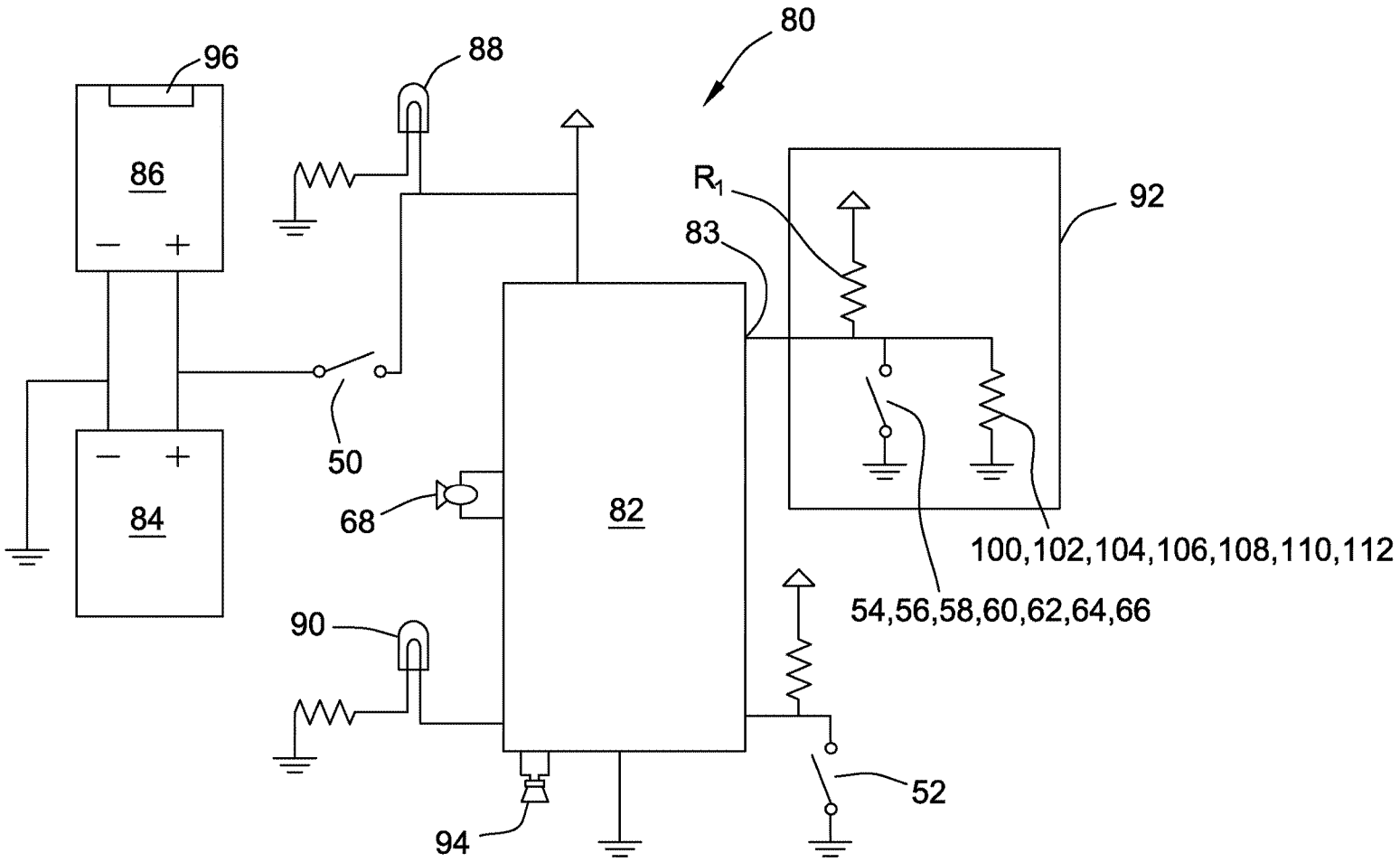
FIG. 5 is a schematic diagram of one embodiment of the electronic recording circuit shown in FIG. 4.

FIG. 5 is a schematic diagram of one embodiment of the recording system 80 shown in FIG. 4. In addition to each of the audio recording/playback circuits 92 including one of the record buttons 54, 56, 58, 60, 62, 64, and 66, and corresponding switches 100, 102, 104, 106, 108, 110, and 112, each circuit 92 includes a pull-up resistor R1. In the exemplary embodiment, each of the record buttons 54, 56, 58, 60, 62, 64, and 66 is a normally open switch, having one side electrically coupled to ground and the other side electrically coupled to a respective one of the record inputs 83 of microprocessor 82. In addition, the pull-up resistor R1 is coupled to power to maintain a positive voltage when the record button 54, 56, 58, 60, 62, 64, and 66 is open. Furthermore, the switches 100, 102, 104, 106, 108, 110, and 112 are connected between the record inputs 83 of microprocessor 82 and ground. When the global record switch 52 is closed, the microprocessor 82 input is pulled to ground, thus enabling the recording function of the microprocessor 82. While the global record switch 52 is closed, one of the record buttons 54, 56, 58, 60, 62, 64, and 66 can be closed, thereby pulling the respective record input 83 of microprocessor 82 to ground and initiating the recording function for the particular record input 83. The message 87 may then be recorded. To initiate playback of the message 87, one of the switches 100, 102, 104, 106, 108, 110, and 112 is actuated, e.g., exposed to ambient light, thereby causing the resistance to drop to a level low enough to pull the playback input 85 to ground, triggering playback of the personalized message 87.

Alternatively, it is contemplated that the plurality of record buttons 54, 56, 58, 60, 62, 64, and 66 may be omitted from the recording system 80. In such an embodiment, the plurality of switches 100, 102, 104, 106, 108, 110, and 112 function as both a recording switch and a playback switch. More specifically, each of the switches 100, 102, 104, 106, 108, 110, and 112 is a normally open switch, having one side electrically coupled to ground and the other side electrically coupled to a respective one of the record inputs 83 and playback inputs 85 of microprocessor 82. In addition, the pull-up resistor R1 is coupled to power to maintain a positive voltage when the switches 100, 102, 104, 106, 108, 110, and 112 are open. When the global record switch 52 is closed, the microprocessor 82 input is pulled to ground, thus enabling the recording function of the microprocessor 82. While the global record switch 52 is closed, one of the switches 100, 102, 104, 106, 108, 110, and 112 can be closed, e.g., exposed to ambient light sufficient to actuate the respective switch, thereby pulling the respective record input 83 of microprocessor 82 to ground and initiating the recording function for the particular record input 83. The message 87 may then be recorded and the respective switch 100, 102, 104, 106, 108, 110, and 112 opened. To initiate playback of the message 87, the respective one of the switches 100, 102, 104, 106, 108, 110, and 112 is actuated, e.g., exposed to ambient light, thereby causing the resistance to drop to a level low enough to pull the playback input 85 to ground, triggering playback of the personalized message 87.

To make use of puzzle 10, a user places a picture (not shown) within at least one of the second cavities 26 of the drawer 24. The user then positions the drawer 24 within the first cavity 28 of the puzzle 10. The user places power switch 50 into "on" position, thereby providing operational power to the recording system 80. In the example embodiment, the user also activates global record switch 52, enabling the recording functions of all audio recording/playback circuits 92.

The user then activates one of the record buttons 54, 56, 58, 60, 62, 64, and 66, for example by holding the button down, to initiate the recording function of the corresponding recording/playback circuit 92. In the example embodiment, the user records a personalized message 87 by speaking into microphone 68. After finishing the message 87, the user deactivates the record button 54, 56, 58, 60, 62, 64, or 66, for example by releasing the button, which stops the recording function. The user may then deactivate the global record switch 52 to prevent the recording function from being inadvertently re-initiated. Alternatively, in one suitable embodiment having the record buttons 54, 56, 58, 60, 62, 64, and 66 omitted, the user activates one of the switches 100, 102, 104, 106, 108, 110, and 112, for example by removing the puzzle corresponding piece 18 and exposing the switch to ambient light, to initiate the recording function of the corresponding recording/playback circuit 92. The user records a personalized message 87 by speaking into microphone 68. After finishing the message 87, the user deactivates the switch 100, 102, 104, 106, 108, 110, or 112, for example by replacing the corresponding puzzle piece 18, which stops the recording function. The user may then deactivate the global record switch 52 to prevent the recording function from being inadvertently re-initiated.

To play back the message 87 after it has been stored by the microprocessor 82, the user removes the corresponding puzzle piece 18 from the puzzle 10. The corresponding one of the switches 100, 102, 104, 106, 108, 110, and 112 positioned in the cutout 20 vacated by the removed puzzle piece 18 is actuated, e.g., by ambient light falling on it, thereby activating the corresponding playback input 85 and initiating playback of the message 87 via speaker 94.

As shown in FIG. 4, in the example embodiment, the recording system 80 of the puzzle 10 is powered by a rechargeable battery 84. The battery 84 outputs a voltage in the range between about 3 volts to about 5 volts, which is used to power the recording system 80. In addition, the recording system 80 includes a battery charger 86 that has a built-in USB port 96. The charger 86 is configured to convert the 5 volts received from a USB connection into a suitable voltage level to charge the battery 84. In the exemplary embodiment, a USB charging cable (not shown) can be coupled to or removed from the charger 86 at any time without affecting operation of recording system 80.

Some embodiments involve the use of one or more electronic or computing devices. Such devices typically include a microprocessor, such as, without limitation, a general purpose central processing unit (CPU), a reduced instruction set computer (RISC) processor, an application specific integrated circuit (ASIC), and/or any other circuit or processor capable of executing the functions described herein. The methods described herein may be encoded as executable instructions embodied in a computer readable medium, including, without limitation, a storage device, and/or a memory device. Such instructions, when executed by a processor, cause the processor to perform at least a portion of the methods described herein. The above examples are for illustration only, and are not intended to limit in any way the definition and/or meaning of the term processor.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

Approximating language, as used herein throughout the specification and claims, may be applied to modify any quantitative representation that could permissibly vary without resulting in a change in the basic function to which it is related. Accordingly, a value modified by a term or terms, such as "about" and "substantially", are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise.

As various changes could be made in the above constructions without departing from the scope of the invention, it is intended that all matter contained in the above description and shown in the accompanying drawings shall be interpreted as illustrative and not in a limiting sense.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A user-customizable audio-visual puzzle comprising:

a platform comprising:

a base layer;

a middle layer coupled to said base layer, said middle layer defining a first cavity therein; and a top layer coupled to said middle layer, said top layer comprising at least one cutout;

at least one puzzle piece having a peripheral configuration shaped to correspond to said at least one cutout;

a drawer configured to be removably positionable within said first cavity, said drawer comprising at least one second cavity configured to be positioned generally beneath said at least one cutout when said drawer is positioned within said first cavity; and a recording system configured to record a message associated with said at least one cutout.

2. The user-customizable audio-visual puzzle in accordance with claim 1 further comprising a background image disposed on said top layer, and a puzzle piece image disposed on said at least one puzzle piece, wherein said puzzle piece image and said background image are configured to assist a user in correct placement of said at least one puzzle piece into said at least one cutout.

3. The user-customizable audio-visual puzzle in accordance with claim 1 further comprising a global recording switch operable to selectively prevent said recording system from recording the message.

4. The user-customizable audio-visual puzzle in accordance with claim 1 further comprising a button configured to enable said recording system to receive a sound signal from a microphone and store the sound signal as the message.

5. The user-customizable audio-visual puzzle in accordance with claim 1, wherein said recording system comprises a switch positioned within said at least one cutout, wherein activation of said switch causes said recording system to play the message from a speaker.

6. The user-customizable audio-visual puzzle in accordance with claim 5, wherein said switch comprises one of a photocell or a mechanical switch.

7. The user-customizable audio-visual puzzle in accordance with claim 1, wherein said top layer comprises at least one ply of magnetic sheet material, and wherein said at least one puzzle piece comprises at least one ply of magnetic sheet material, such that said at least one puzzle piece is configured to be removably coupled to said top layer via a magnetic attraction force between said top layer and said at least one puzzle piece.

8. The user-customizable audio-visual puzzle in accordance with claim 1, wherein said top layer comprises at least one ply of transparent material positioned beneath said at least one cutout.

9. The user-customizable audio-visual puzzle in accordance with claim 1 further comprising a handle coupled to an edge of said platform.

10. The user-customizable audio-visual puzzle in accordance with claim 9, wherein said handle comprises a hinge coupled to the edge of said platform to enable rotation of said handle with respect to said platform.

11. A user-customizable audio-visual puzzle comprising:

a platform comprising:

a first layer comprising a cutout and a lip that extends inwardly from a periphery of said cutout, said lip comprising a magnetic material; and a second layer coupled to said first layer, said second layer defining a first cavity therein;

a puzzle piece comprising a magnetic material and having a peripheral configuration shaped to correspond to said cutout, said puzzle piece configured to be removably coupled to said first layer by a magnetic attraction force between said lip of said first layer and said at least one puzzle piece;

a drawer configured to be removably positionable within said first cavity; and a recording system configured to record a message associated with said cutout, said recording system comprising:

a microphone for receiving a sound signal corresponding to the message;

a speaker for playing the message; and a switch positioned within said cutout, wherein activation of said switch causes said recording system to play the message from said speaker.

12. The user-customizable audio-visual puzzle in accordance with claim 11, wherein said drawer comprises a second cavity configured to be positioned beneath said cutout when said drawer is positioned within said first cavity.

13. The user-customizable audio-visual puzzle in accordance with claim 11 further comprising a background image disposed on said first layer, and a puzzle piece image disposed on said puzzle piece, wherein said puzzle piece image and said background image are configured to assist a user in correct placement of said puzzle piece into said cutout.

14. The user-customizable audio-visual puzzle in accordance with claim 11, wherein said recording system further comprises a global recording switch operable to selectively prevent said recording system from recording the message.

15. The user-customizable audio-visual puzzle in accordance with claim 14, activation of said switch causes said recording system to record the message via said microphone when said global recording switch is activated to enable said recording system to record the message.

16. The user-customizable audio-visual puzzle in accordance with claim 11, wherein said recording system further comprises a button configured to enable said recording system to receive the sound signal from said microphone and store the sound signal as the message.

17. The user-customizable audio-visual puzzle in accordance with claim 11, wherein said switch comprises one of a photocell or a mechanical switch.

18. The user-customizable audio-visual puzzle in accordance with claim 11, wherein said recording system further comprises a processor, said processor comprising a plurality of record inputs, wherein a respective record input of said plurality of record inputs is configured to enable said processor to selectively receive one of a plurality of discrete audio messages.

19. The user-customizable audio-visual puzzle in accordance with claim 18, wherein said processor further comprises a plurality of playback inputs, wherein a respective playback input of said plurality of playback inputs is configured to enable said processor to selectively play back one of the plurality of discrete audio messages.

20. The user-customizable audio-visual puzzle in accordance with claim 11, wherein said recording system further comprises a battery and a battery charging circuit coupled to said battery.

* * * * *